US008469173B2

(12) United States Patent
Inuki et al.

(10) Patent No.: US 8,469,173 B2
(45) Date of Patent: Jun. 25, 2013

(54) COIN HANDLING SYSTEM

(75) Inventors: Yusuke Inuki, Himeji (JP); Fumio Yamaguchi, Himeji (JP)

(73) Assignee: Glory Ltd., Himeji-shi, Hyogo-ken (JP)

( * ) Notice: Subject to any disclaimer, the term of this patent is extended or adjusted under 35 U.S.C. 154(b) by 137 days.

(21) Appl. No.: 12/737,520

(22) PCT Filed: Jul. 23, 2009

(86) PCT No.: PCT/JP2009/063191

§ 371 (c)(1),
(2), (4) Date: May 9, 2011

(87) PCT Pub. No.: WO2010/010923

PCT Pub. Date: Jan. 28, 2010

(65) Prior Publication Data

US 2011/0223847 A1 Sep. 15, 2011

(30) Foreign Application Priority Data

Jul. 23, 2008 (JP) ..... 2008-190002

(51) Int. Cl.
*G07D 3/00* (2006.01)
*G07D 3/14* (2006.01)

(52) U.S. Cl.
USPC ..... 194/217

(58) Field of Classification Search
USPC ..... 194/215, 216, 217, 350; 453/3; 700/90, 700/213, 223, 226; 902/9, 11, 17; 209/2, 209/509, 552
See application file for complete search history.

(56) References Cited

U.S. PATENT DOCUMENTS

| | | | | |
|---|---|---|---|---|
| 4,747,492 A | | 5/1988 | Saito et al. | 209/534 |
| 5,230,653 A | * | 7/1993 | Shinozaki et al. | 453/4 |
| 6,039,644 A | | 3/2000 | Geib et al. | |

FOREIGN PATENT DOCUMENTS

| | | |
|---|---|---|
| EP | 0 620539 A1 | 10/1994 |
| EP | 1 107 193 A2 | 6/2001 |
| JP | 01-106291 | 4/1989 |
| JP | 2005-196723 | 7/2005 |
| JP | 2006-202036 | 8/2006 |
| JP | 2007-004640 | 1/2007 |
| JP | 2007-156962 | 6/2007 |
| JP | 2008-059472 | 3/2008 |
| WO | WO 2007/043113 A1 | 4/2007 |

OTHER PUBLICATIONS

European Search Report (Application No. 0980043.7 PCT/JP2009/063191) (6 pages—Date Mar. 16, 2012).
International Preliminary Report of PCT/JP2009/063191 (8 pages—dated Mar. 17, 2011).

* cited by examiner

*Primary Examiner* — Mark Beauchaine
(74) *Attorney, Agent, or Firm* — Renner, Kenner, Greive, Bobak, Taylor & Weber

(57) ABSTRACT

There is provided a coin handling system including: a reception unit, a recognition unit, a storing unit having a plurality of cassettes configured to store the coin that has been recognized by the recognition unit, a coin guiding unit configured to guide to any of the cassettes the coin that has been recognized by the recognition unit, a storage unit for storing a plurality of storing patterns of the coin into the plurality of cassettes, a selecting unit for selecting a specific storing pattern among the plurality of storing patterns, and a control unit configured to control the coin guiding unit in such a manner that the coin that has been recognized by the recognition unit is stored in a corresponding cassette, in accordance with the selected storing pattern, when a specific storing pattern is selected among the plurality of storing patterns.

10 Claims, 10 Drawing Sheets

COIN HANDLING SYSTEM

CROSS-REFERENCE TO RELATED APPLICATION

This application is the National Stage of International Application No. PCT/JP2009/063191 filed Jul. 23, 2009 which is based on JP2008-190002 filed Jul. 23, 2008 from which priority is claimed.

FIELD OF THE INVENTION

The present invention relates to a coin handling system. In particular, the present invention relates to a coin handling system used for a deposit process.

BACKGROUND ART

In a conventional coin handling system used for a deposit process, the put-in coins are stored in one of a plurality of storing units for each denomination. As an example of this type of coin handling system, there is known a coin handling system that has been disclosed in JP 2007-4640A.

This type of coin handling system includes coin escrow units for respective denominations, storing-and-feeding units for respective denominations, and so on. In this coin handling system, coins are escrowed in the coin escrow units for respective denominations, and the escrowed coins are stored in the storing-and-feeding units for respective denominations after a deposit-acceptance instruction has been received.

However, in this coin handling system, since the coins are stored in the storing-and-feeding units for respective denominations, the number of storing-and-feeding units to be required is the number of all denominations in circulation in the market. Thus, when the capacity of each storing unit is large, the system also has to become large. When the capacity of each storing unit is small, the efficiency of processing by the system is deteriorated.

On the other hand, there is known another type of coin handling system in which coins are stored in a denomination mixed state in storing units whose number is smaller than the number of denominations in circulation in the market. This type of coin handling system is more compact and more efficient than the coin handling system disclosed in JP 2007-4640A.

However, in this coin handling system, since the coins are stored in a denomination mixed state, the stored coins have to be sorted by denomination in a subsequent process (for example, a wrapping process) after the deposit process. The sorting process is carried out by an operator. Thus, the deposit process is carried out efficiently, but the efficiency of the subsequent process after the deposit process is deteriorated.

DISCLOSURE OF THE INVENTION

That is to say, in the conventional coin handling systems, it is not possible to improve the efficiency of the subsequent process after the deposit process while achieving compactness of the system. In particular, the number of coins of one denomination in circulation is very different from those of the other denominations. In addition, the difference also depends on the status of utilization by the user of the coin handling system.

Thus, the conventional coin handling systems cannot solve the above problem for every status of utilization by the users.

The present invention has been made in view of the above circumstances. The object of the present invention is to provide a coin handling system which can improve an efficiency of a subsequent process after a deposit process while achieving compactness of the system, for every status of utilization by users.

The present invention is a coin handling system including: a reception unit configured to receive a coin that has been put therein, a recognition unit configured to recognize the coin that has been received by the reception unit, a storing unit having a plurality of cassettes configured to store the coin that has been recognized by the recognition unit, a coin guiding unit configured to guide to any of the cassettes the coin that has been recognized by the recognition unit, a storage unit for storing a plurality of storing patterns of the coin into the plurality of cassettes, a selecting unit for selecting a specific storing pattern among the plurality of storing patterns, and a control unit configured to control the coin guiding unit in such a manner that the coin that has been recognized by the recognition unit is stored in a corresponding cassette, in accordance with the selected storing pattern, when a specific storing pattern is selected among the plurality of storing patterns.

According to the present invention, it is possible to provide a coin handling system which can improve an efficiency of a subsequent process after a deposit process while achieving compactness of the system, for every status of utilization by users.

Preferably, the storing unit is drawable in a direction in which the plurality of cassettes are arranged, and the storage unit stores, as one of the plurality of storing patterns, a storing pattern in accordance with which coins are stored in a denomination mixed state in the cassettes in order beginning from the front side in the drawable direction of the storing unit.

In addition, preferably, an escrow unit configured to escrow the coin is provided for each of the plurality of cassettes, and the storage unit stores, as one of the plurality of storing patterns, a storing pattern in accordance with which coins that have reached a maximum number in an escrow unit are stored in a cassette corresponding to the escrow unit among the escrow units corresponding to the respective cassettes.

In addition, preferably, the storage unit stores, as one of the plurality of storing patterns, a storing pattern in accordance with which coins of a predetermined specified denomination are stored in one of the cassettes and in accordance with which coins of a non-specified denomination are stored in the other cassettes in a denomination mixed state.

In addition, preferably, the storage unit stores, as one of the plurality of storing patterns, a storing pattern in accordance with which coins of two kinds of denomination are stored in each of the cassettes in a two-denomination mixed state.

In addition, preferably, the selecting unit has an operation unit for receiving a selection instruction for selecting a specific storing pattern among the plurality of storing patterns.

In addition, preferably, the storage unit is configured to further store a recognition history by the recognition unit, and the selecting unit is configured to select a specific storing pattern among the plurality of storing patterns, based on the recognition history stored in the storage unit.

In addition, preferably, the coin handling system further includes a storing-pattern editing unit configured to create a new storing pattern and cause the storage unit to store the new storing pattern as one of the plurality of storing patterns.

In this case, preferably, the storage unit is configured to further store a recognition history by the recognition unit, and the storing-pattern editing unit is configured to create a new storing pattern based on the recognition history stored in the storage unit.

In this case, preferably, the storing-pattern editing unit has an operation unit for receiving an edit instruction for editing the new storing pattern.

BEST MODE FOR CARRYING OUT THE INVENTION

Embodiments according to the present invention will be described herebelow with reference to the drawings. The following embodiments are mere examples of the present invention, and thus do not limit the scope of the present invention.

First, the embodiment 1 according to the present invention is explained. The embodiment 1 relates to an example in which coins are escrowed based on a predetermined storing pattern, and the escrowed coins are stored in a storing unit after a deposit-acceptance instruction has been received.

At first, the structure of a coin handling system in the embodiment 1 according to the present invention is explained with reference to FIGS. 1 to 5.

Figure 1:
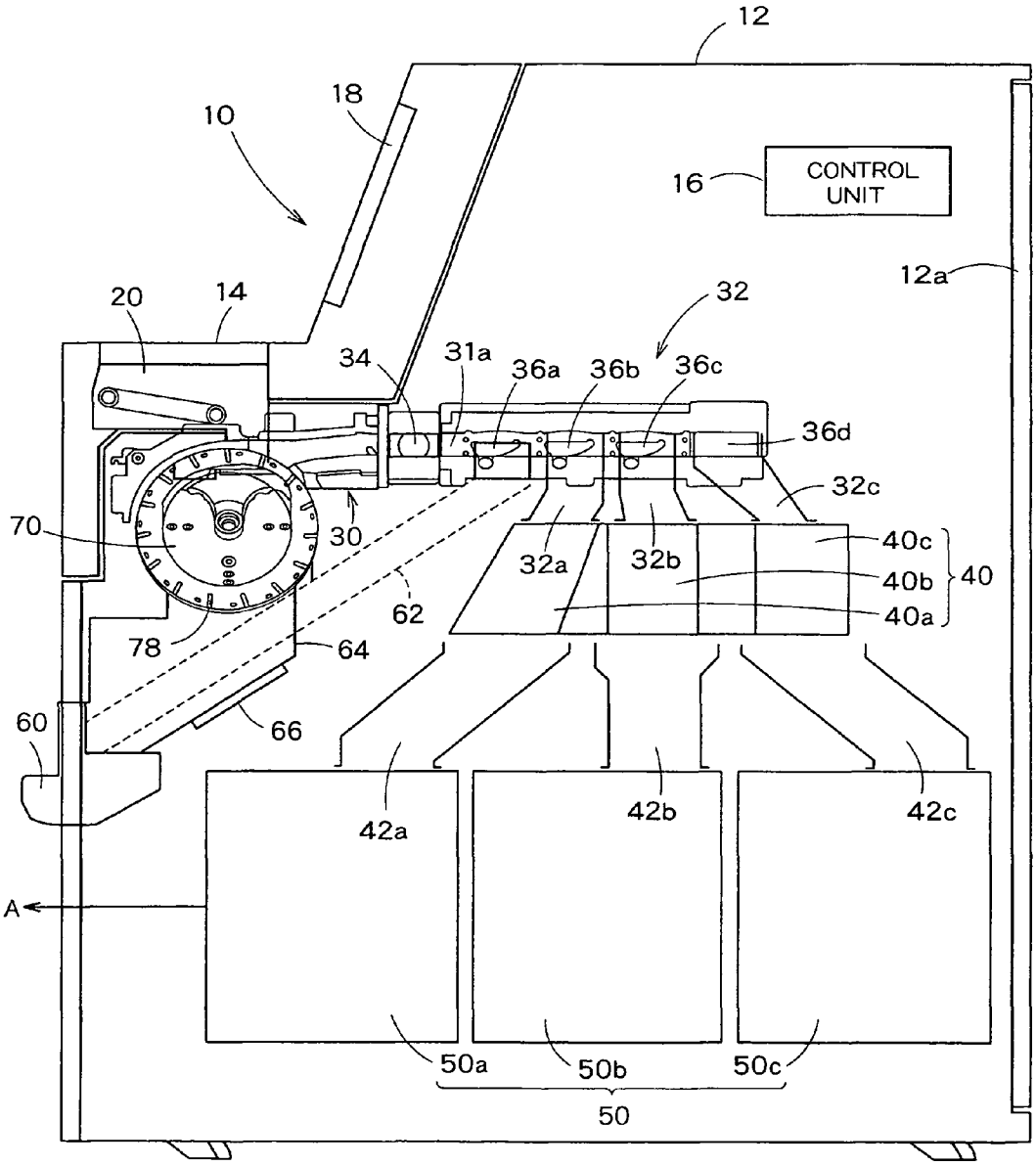
FIG. 1 is a schematic view showing an inside structure of a coin handling system in an embodiment according to the present invention.
Figure 2:
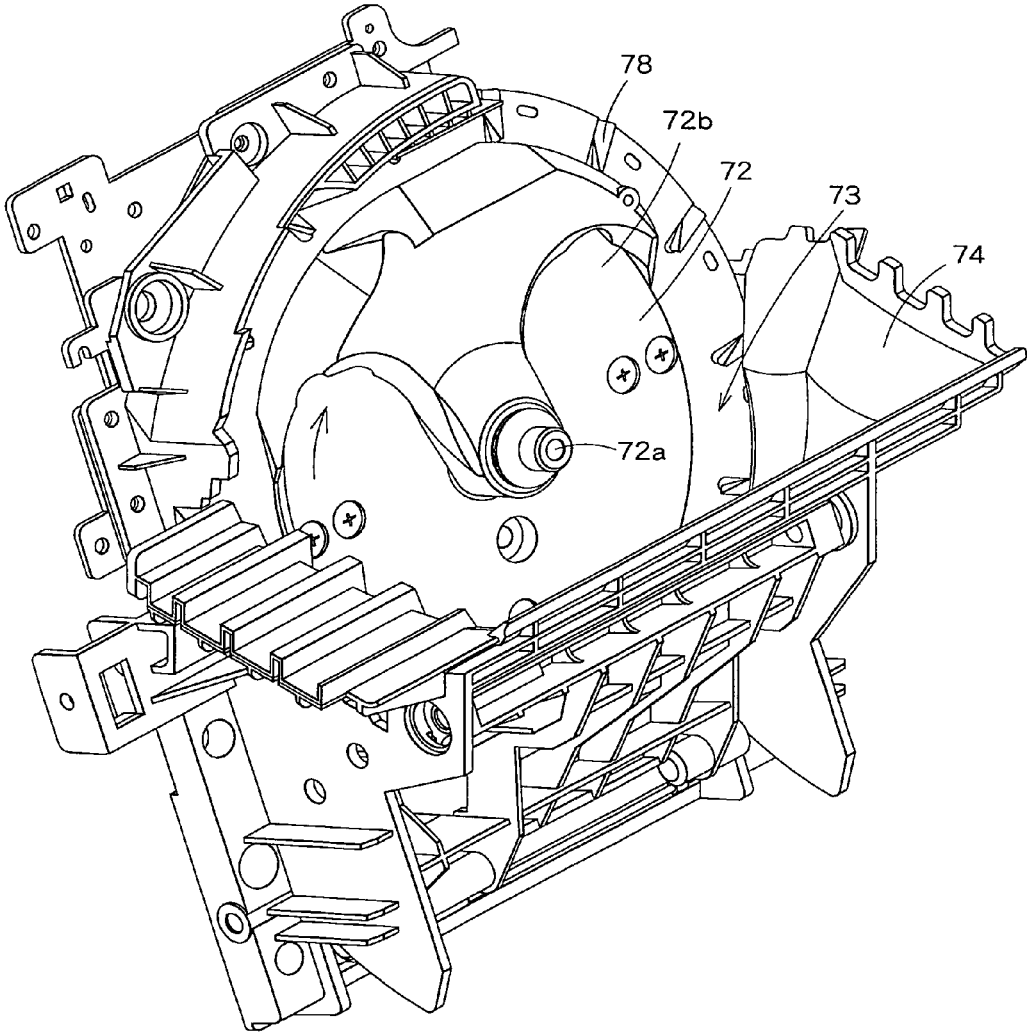
FIG. 2 is a perspective view showing details of a structure of a coin holding-and-feeding-out unit in the coin handling system of FIG. 1.
Figure 3A:
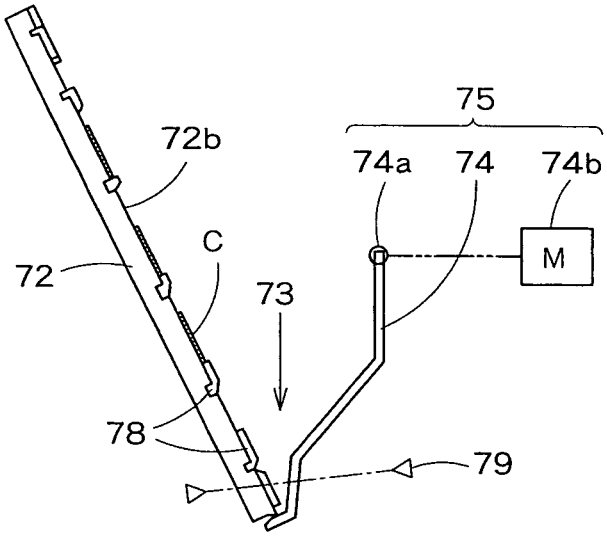
FIG. 3A is a side view of the coin holding-and-feeding-out unit of FIG. 2 in such a state that a hopper member is closed and that a coin holding space is formed between the hopper member and a surface of a rotatable disk.
Figure 3B:
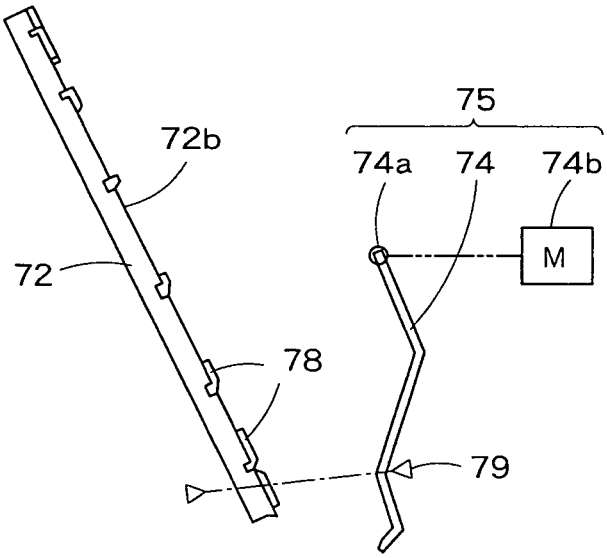
FIG. 3B is a side view of the coin holding-and-feeding-out unit of FIG. 2 in such a state that the hopper member is opened.
Figure 4A:
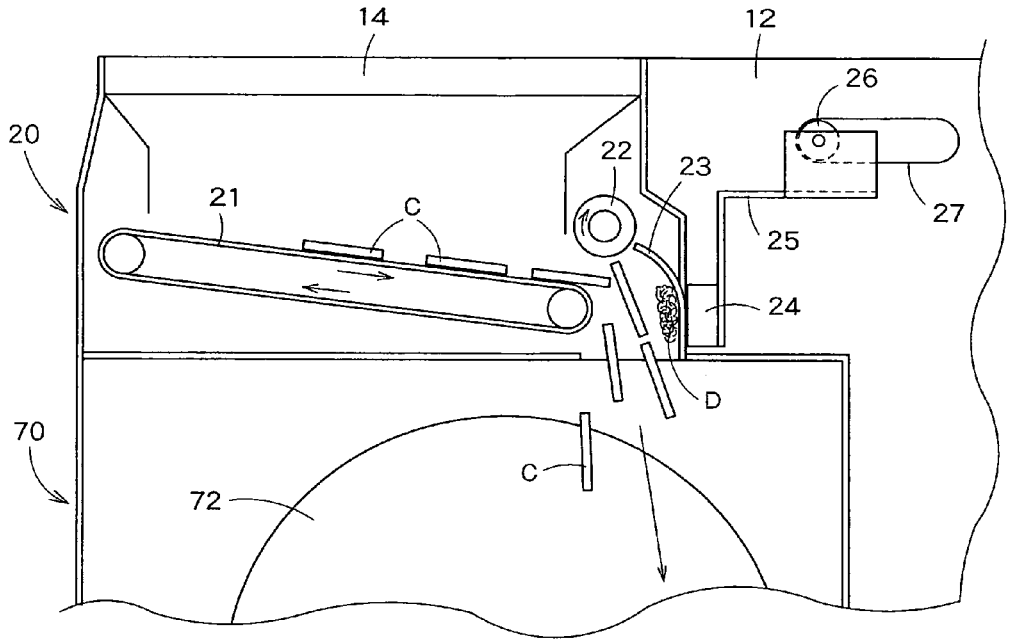
FIG. 4A is a schematic view showing details of a structure of a supply unit in the coin handling system of FIG. 1 in such a state that an object-absorption unit is located at an advanced position thereof.
Figure 4B:
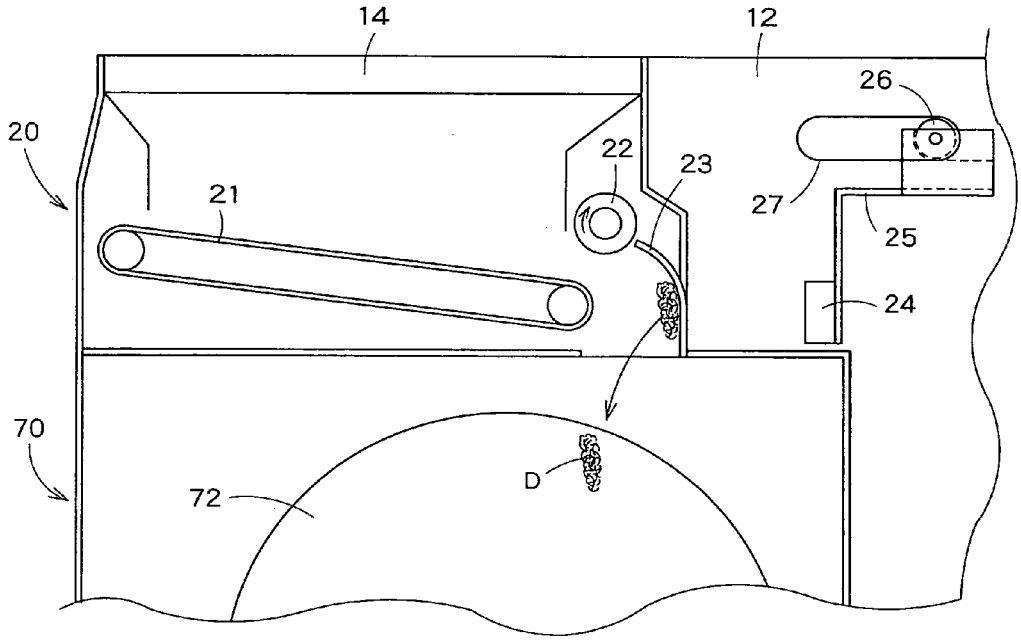
FIG. 4B is a schematic view showing details of the structure of the supply unit in the coin handling system of FIG. 1 in such a state that the object-absorption unit is located at a back position.

FIG. 1 is a schematic view showing an inside structure of the coin handling system in the embodiment 1 according to the present invention. FIG. 2 is a perspective view showing details of a structure of a coin holding-and-feeding-out unit in the coin handling system of FIG. 1. FIG. 3A is a side view of the coin holding-and-feeding-out unit of FIG. 2 in such a state that a hopper member is closed and that a coin holding space is formed between the hopper member and a surface of a rotatable disk. FIG. 3B is a side view of the coin holding-and-feeding-out unit of FIG. 2 in such a state that the hopper member is opened. FIG. 4A is a schematic view showing details of a structure of a supply unit in the coin handling system of FIG. 1 in such a state that an object-absorption unit is located at an advanced position thereof. FIG. 4B is a schematic view showing details of the structure of the supply unit in the coin handling system of FIG. 1 in such a state that the object-absorption unit is located at a back position.

As shown in FIG. 1, the coin handling system 10 includes a housing 12 of a substantially rectangular parallelepiped shape, an inlet 14 through which a coin is put into the inside from an outside of the housing 12, a supply unit 20 for supplying a coin holding-and-feeding-out unit 70, which will be described below, with a coin that has been put into the inlet 14, and the coin holding-and-feeding-out unit 70 configured to hold the coin that has been supplied by the supply unit 20 and to feed out the held coin. The inlet 14, the supply unit 20 and the coin holding-and-feeding-out unit 70 constitute a reception unit configured to receive a coin to the inside of the coin handling system 10. Connected to the coin holding-and-feeding-out unit 70 is a transport unit 30 configured to transport a coin, which has been fed out from the coin holding-and-feeding-out unit 70, in the inside of the housing 12. The transport unit 30 is provided with a recognition unit 34 configured to recognize a denomination, a fitness and an authenticity of the coin. A sorting unit 32 (a part of a coin guiding unit) is connected to a downstream side of the transport unit 30. The sorting unit 32 is configured to sort coins, which have been transported from the transport unit 30, by denomination or in a mixed state, based on the recognition result of the recognition unit 34.

To be specific, a coin transport path 31*a* (a part of the coin guiding unit) of the sorting unit 32 has a plurality of (specifically, e.g., three) openings 36*a*, 36*b* and 36*c* (a part of the coin guiding unit). The respective openings 36*a*, 36*b* and 36*c* communicate with a rejected-coin chute 62 and other chutes 32*a* and 32*b*. When coins transported along the transport path 31*a* enter the respective openings 36*a*, 36*b* and 36*c*, the coins are respectively sent to the rejected-coin chute 62 and the chutes 32*a* and 32*b*. In addition, at a downstream-side end of the transport path 31*a*, an opening 36*d* is formed on a further downstream side of the respective openings 36*a*, 36*b* and 36*c*. The opening 36*d* communicates with a further chute 32*c*. When a coin transported by the transport path 31*a* does not enter any of the openings 36*a*, 36*b* and 36*c*, the coin is transported to the downstream-side end of the transport path 31*a* so as to enter the opening 36*d*. The coin having entered the opening 36*d* is sent to the chute 32*c*.

As described above, the rejected-coin chute 62 is connected to the sorting unit 32, so that a coin that could not be recognized by the recognition unit 34 and a coin that has been recognized as an abnormal coin by the recognition unit 34 are sent as rejected coins from the sorting unit 32 to the rejected-coin chute 62. A reject unit 60 accessible from the outside of the housing 12 is disposed at a downstream-side end of the rejected-coin chute 62, and a rejected coin is sent from the rejected-coin chute 62 to the reject unit 60. Thus, an operator can take out the rejected coin from the reject unit 60. In addition, a discharge chute 64 is disposed below the coin holding-and-feeding-out unit 70, and an object having been sent from the coin holding-and-feeding-out unit 70 to the discharge chute 64 is also sent to the reject unit 60. As shown in FIG. 1, a shock sensor 66 is disposed adjacently to the discharge chute 64. An object falling down from the coin holding-and-feeding-out unit 70 to the discharge chute 64 collides with the shock sensor 66. When an object having collided with the shock sensor 66 is a deformed coin, a metal object other than coins, or another solid object, the shock sensor 66 is configured to detect that an object has collided with the shock sensor 66. On the other hand, when an object having collided with the shock sensor 66 is a paper scrap or dust, the shock sensor 66 cannot detect that the paper scrap or the dust has collided with the shock sensor 66. The detection information by the shock sensor 66 is sent to a control unit 16, which will be described below.

An escrow unit 40 is disposed below the sorting unit 32. The escrow unit 40 consists of a plurality of (e.g., three) escrow parts 40*a*, 40*b* and 40*c* configured to escrow coins by denomination or in a mixed state. Coins having been sorted by the sorting unit 32 are adapted to be sent to these escrow parts 40*a*, 40*b* and 40*c* through the chutes 32*a*, 32*b* and 32*c* (a part of the coin guiding unit) respectively corresponding to the escrow parts 40*a*, 40*b* and 40*c*. In addition, a storing unit 50 is disposed below the escrow unit 40. The storing unit 50 consists of a plurality of (e.g., three) cassettes 50*a*, 50*b* and 50*c* configured to store coins by denomination or in a mixed state. Coins having been escrowed in the respective escrow parts 40*a*, 40*b* and 40*c* are adapted to be sent to these cassettes 50*a*, 50*b* and 50*c* through chutes 42*a*, 42*b* and 42*c* (a part of the coin guiding unit) respectively corresponding to the cassettes 50*a*, 50*b* and 50*c*. The storing unit 50 is drawable in parallel with (A direction in FIG. 1) a direction in which the cassettes 50*a*, 50*b* and 50*c* are arranged. Namely, when the storing unit 50 is drawn out, the cassettes 50*a*, 50*b* and 50*c* are drawn out in this order.

As shown in FIG. 1, the supply unit 20, the coin holding-and-feeding-out unit 70, the transport unit 30, the sorting unit 32, the recognition unit 34, the escrow unit 40, the storing unit 50 and so on are accommodated inside the housing 12. By opening a lid 12*a* of the housing 12 of the coin handling system 10, the coins stored in the storing unit 50 can be collected by a specific collection staff such as a guard of an armoured car company, who is entrusted with the collection of cash, or a clerk of a bank.

As shown in FIG. 1, a display unit 18 formed of, e.g., a touch panel is disposed on a surface of the housing 12. The display unit 18 is configured to display a process state of coins in the coin handling system 10, and the number and/or amount of coins stored in each of the cassettes 50*a*, 50*b* and 50*c* of the storing unit 50. The display contents of the display unit 18 are controlled by the below-described control unit 16.

The coin handling system 10 is provided with the control unit 16 configured to control the respective structural elements of the coin handling system 10. To be specific, the control unit is configured to control the supply unit 20, the coin holding-and-feeding-out unit 70, the sorting unit 32, the escrow unit 40, the display unit 18 and so on. In addition, information about a recognition result of coins from the recognition unit 34 and detection information by the shock sensor 66 are sent to the control unit 16.

Hereinbelow, the details of the respective structural elements of the coin handling system 10 are described.

As shown in FIG. 1, the supply unit 20 is disposed at a position directly below the inlet 14. The supply unit 20 is configured to receive a plurality of coins in a mixed state, which have been put into the inlet 14 by an operator. The coins received by the supply unit 20 are then sent to the coin holding-and-feeding-out unit 70 disposed at a position directly below the supply unit 20.

The concrete structure of the supply unit 20 is described with reference to FIGS. 4A and 4B. As described above, FIG. 4A is a schematic view showing details of the structure of the supply unit 20 in such a state that a permanent magnet 24, which will be described below, is located at an advanced position thereof. FIG. 4B is a schematic view showing a state that the permanent magnet 24 is located at a back position. As shown in FIG. 4A and so on, the supply unit 20 is equipped with a transport conveyor 21. All the coins (shown by the reference symbol C in FIG. 4A) and foreign objects other than coins, which have been put into the inlet 14, are placed on the transport conveyor 21. By circulating the transport conveyor 21 in a direction shown by the arrows in FIG. 4A, the objects on the transport conveyor 21 are sent to the coin holding-and-feeding-out unit 70. A reverse roller 22, which rotates in a direction shown by the arrow in FIG. 4A, is disposed above an end part of the transport conveyor 21 (a right end part in FIG. 4A). The objects on the transport conveyor 21 pass through a gap between the transport conveyor 21 and the reverse roller 22 so as to be sent to the coin holding-and-feeding-out unit 70.

In addition, a guide member 23 made of a nonmetal material such as plastics is disposed near to the end (the right end part in FIG. 4A) of the transport conveyor 21. The objects having passed through the gap between the transport conveyor 21 and the reverse roller 22 are guided by the guide member 23 to the coin holding-and-feeding-out unit 70. The permanent magnet 24 is disposed in an area opposite to the transport conveyor 21 with respect to the guide member 23. The permanent magnet 24 is held by a holding member 25 such that the permanent magnet 24 can be reciprocated in the right and left direction in FIG. 4A. More specifically, the holding member 25 holding the permanent magnet 24 has a cam 26. The cam 26 is located in an elongated hole 27 formed in the housing 12, the elongated hole 27 extending in the right and left direction in FIG. 4A. When the cam 26 is also moved along the, elongated hole 27 formed in the housing 12 in the right and left direction in FIG. 4A, the permanent magnet 24 is moved in the right and left direction in FIG. 4A, so that the permanent magnet 24 is reciprocated between an advanced position thereof adjacent to the guide member 23, which is shown in FIG. 4A, and a back position apart form the guide member 23, which is shown in FIG. 4B. The movement of the guide member 23 in the right and left direction in FIG. 4A is controlled by the control unit 16, whereby the position of the permanent magnet 24 is controlled by the control unit 16.

When an object sent from the transport conveyor 21 along the guide member 23 to the coin holding-and-feeding-out unit 70 has magnetism, the permanent magnet 24 constitutes an object-absorption unit that selectively absorbs the object (shown by the reference symbol D in FIGS. 4A and 4B) by a magnetic force. Herein, the "object-absorption unit configured to selectively absorb an object having magnetism by a magnetic force" means that the object-absorption unit can switch between a state in which the object-absorption unit absorbs an object having magnetism, and another state in which the object-absorption unit does not absorb the object having magnetism. To be more specific, as shown in FIG. 4A, when the permanent magnet 24 is located at the advanced position adjacent to the guide member 23, the permanent magnet 24 absorbs (attracts), among objects guided by the guide member 23, a metal object other than coins via the guide member 23 by a magnetic force. On the other hand, as shown in FIG. 4B, when the permanent magnet is moved to the back position apart from the guide member 23, the permanent magnet 24 does not absorb the object having magnetism on the guide member 23, so that the object falls down from the guide member 23 and is sent to be the coin holding-and-feeding-out unit 70.

When a coin is supplied from the supply unit 20 to the coin holding-and-feeding-out unit 70, the control unit 16 controls the permanent magnet 24 such that the permanent magnet 24 is previously moved to the advanced position as shown in FIG. 4A. Thus, even when an object having magnetism other than coins, for example, a metal object such as a clip is put into the inlet 14 and the object is sent to the supply unit 20, the object is absorbed by the permanent magnet 24 and thus is not sent to the coin holding-and-feeding-out unit 70. After the feeding-out operation of coins by the coin holding-and-feeding-out unit 70 has been finished, the control unit 16 controls the permanent magnet 24 such that the permanent magnet 24 is moved to the back position as shown in FIG. 4B, so that the object absorbed by the permanent magnet 24 is released from the permanent magnet 24 so as to fall down from the guide member 23, whereby the object is supplied to the coin holding-and-feeding-out unit 70.

As shown in FIGS. 1 to 3, the coin holding-and-feeding-out unit 70 includes a rotatable disk 72 inclined at a predetermined angle relative to the vertical direction, and a hopper member 74 that forms a coin holding space 73 for holding coins between the hopper member 74 and a surface 72*b* of the rotatable disk 72. As shown in FIG. 2 and so on, the rotatable disk 72 has a rotary shaft 72*a*. Due to the rotary shaft 72*a*, the rotatable disk 72 is rotated in the direction shown by the arrow in FIG. 2, with the rotatable disk 72 being inclined at the predetermined angle with respect to the vertical direction.

In addition, a plurality of projecting members 78 are disposed on the surface 72*b* of the rotatable disk 72 on the side of the coin holding space 73 (the right surface in FIGS. 3A and 3B). These projecting members 78 are disposed at equal intervals therebetween at positions near to an edge portion of the rotatable disk 72 along the edge portion thereof. As shown in FIG. 3A and so on, each projecting member 78 can catch a coin (shown by the reference symbol C in FIG. 3A) on the surface 72*b* of the rotatable disk 72. Thus, a coin in a lower area of the rotatable disk 72 is transported to an upper area of the rotatable disk 72 together with the rotation of the rotatable disk 72.

In the coin holding-and-feeding-out unit 70, a coin transport mechanism (not shown) formed of, e.g., a transport belt is disposed in the upper area of the rotatable disk 72. The transport belt of the coin transport mechanism is configured to transport a coin, which has been transported from the lower area of the rotatable disk 72 to the upper area thereof by the projecting member 78, to the outside of the coin holding space 73. Specifically, a coin is sent from the coin holding space 73 to the transport unit 30 by the above-described coin transport mechanism.

As shown in FIG. 3A and 3B, the hopper member 74 can be opened and closed. FIG. 3A is a side view of the coin holding-and-feeding-out unit 70 of FIG. 2 in such a state that the hopper member 74 is closed and that the coin holding space 73 is formed between the hopper member 74 and the surface of the rotatable disk 72. FIG. 3B is a side view of the coin holding-and-feeding-out unit 70 of FIG. 2 in such a state that the hopper member 74 is opened. As shown in FIGS. 3A and 3B, the hopper member 74 is rotated about a shaft 74*a*. The shaft 74*a* is provided with a drive motor 74*b* that rotates the shaft 74*a* in a normal direction and a reverse direction. When the drive motor 74*b* rotates the shaft 74*a*, the hopper member 74 is reciprocated between a closed position as shown in FIG. 3A, and an opened position as shown in FIG. 3B. The drive motor 74*b* is controlled by the control unit 16. The hopper member 74, the shaft 74*a* and the drive motor 74*b* constitute a discharge unit 75 configured to discharge an object remaining in the coin holding-and-feeding-out unit 70 from the coin holding-and-feeding-out unit 70. The discharge unit 75 is controlled by the control unit 16.

When the hopper member 74 is located at the closed position as shown in FIG. 3A, the coin holding space 73 is formed between the hopper member 74 and the surface of the rotatable disk 72, so that a plurality of coins in a mixed state are held in the coin holding space 73. On the other hand, when the hopper member 74 is moved from the closed position as shown in FIG. 3A to the opened position as shown in FIG. 3B, various objects including coins in the coin holding space 73 fall down from the coin holding space 73 so as to be sent to the discharge chute 64. The objects having been sent from the coin holding-and-feeding-out unit 70 to the discharge chute 64 are sent to the reject unit 60.

As shown in FIGS. 3A and 3B, the coin holding-and-feeding-out unit 70 has a photosensor 79 that detects presence of an object in the coin holding space 73. The photosensor 79 is composed of a light emitting element and a light receiving element. Light emitted from the light emitting element is received by the light receiving element. When an object is present in the coin holding space 73, the light emitted from the light emitting element is blocked by the object and does not reach the light receiving element. Thus, the photosensor 79 detects that an object is present in the coin holding space 73.

As shown in FIG. 1, the shock sensor 66 is disposed at a position below the coin holding-and-feeding-out unit 70 such that the shock sensor 66 is adjacent to the discharge chute 64. When an object having fallen down from the coin holding-and-feeding-out unit 70 to the discharge chute 64 collides with the shock sensor 66, the shock sensor 66 is configured to detect a degree of collision as a pulse value. When the pulse value is larger than a predetermined threshold value, information that an object has collided with the shock sensor 66 is sent from the shock sensor 66 to the control unit 16. On the other hand, when the detected pulse value is smaller than the predetermined threshold value, no information is sent from the shock sensor 66 to the control unit 16. The predetermined threshold value is set such that the threshold value is larger than a pulse value detected by the shock sensor 66 when a deformed coin, a metal object other than coins, or another solid object has collided with the shock sensor 66, and that the threshold value is smaller than a pulse value detected by the shock sensor 66 when a paper scrap or dust has collided with the shock sensor 66. Thus, the shock sensor 66 is configured to send information that an object has collided with the shock sensor 66, only when a deformed coin, a metal object other than coins, or another solid object has collided with the shock sensor 66.

Next, an operation of the coin handling system 10 as structured above is described below. The below-described operation of the coin handling system 10 is performed by the control unit 16 that controls the respective structural elements of the coin handling system 10.

When one or more coins are put by an operator into the inlet 14 of the coin handling system 10, the coins are sent to the supply unit 20. Then, the predetermined number of coins or all the coins in the supply unit 20 are sent from the supply unit 20 to the coin holding-and-feeding-out unit 70, and the coins having been sent to the coin holding-and-feeding-out unit 70 are held in the coin holding space 73. At this time, the control unit 16 controls the permanent magnet 24 in the supply unit 20 such that the permanent magnet 24 is located at the advanced position as shown in FIG. 4A. Thus, a metal object such as a clip other than coins in the supply unit 20 is absorbed by the permanent magnet 24, so that the metal object is not sent to the coin holding-and-feeding-out unit 70.

When the rotatable disk 72 of the coin holding-and-feeding-out unit 70 is rotated in the direction shown by the arrow in FIG. 2, the coins held in the coin holding space 73 and positioned in the lower area of the rotatable disk 72 are caught by the projecting members 78 on the surface 72*b* of the rotatable disk 72. The coins caught by the projecting members 78 on the surface 72*b* of the rotatable disk 72 are transported from the lower area of the rotatable disk 72 to the upper area thereof. In the upper area of the rotatable disk 72, the coins are guided one by one by a guide member, not shown, to the transport belt (not shown) of the coin transport mechanism. The coins having been sent to the transport belt of the coin transport mechanism are transported one by one by the transport belt to the outside of the coin holding space 73. To be more specific, the coins transported by the transport belt of the coin transport mechanism are transferred to the transport unit 30, and the coins are transported rightward in FIG. 1 one by one by the transport unit 30.

When the coins are transported by the transport unit 30, denomination of each coin is recognized by the recognition unit 34. Coins having been recognized by the recognition unit 34 are sent to the sorting unit 32. Coins which could not be recognized by the recognition unit 34 and/or coins which have been recognized as abnormal coins by the recognition unit 34 are sent from the opening 36*a* of the sorting unit 32 to the reject unit 60 through the rejected-coin chute 62. Then, the operator can take out the coins having been sent to the reject unit 60. On the other hand, under the control of the sorting unit 32 by the control unit 16, coins which have been recognized as normal coins by the recognition unit 34 are respectively sent, dependently on recognized denomination, to the escrow parts 40*a*, 40*b* and 40*c* of the escrow unit 40 through the chutes 32*a*, 32*b* and 32*c*, and the coins are escrowed in the escrow parts 40*a*, 40*b* and 40*c*. Alternatively, coins sorted in a mixed state are sequentially sent from the opening 36*b* to the escrow part 40*a* through the chute 32*a* so as to be escrowed therein. When the predetermined number of coins are stored in the escrow part 40*a* so that the escrow part 40*a* becomes full, the opening 36*b* is switched to the next opening 36*c* for sorting and the process is continued. Thereafter, the coins escrowed in the escrow parts 40*a*, 40*b* and 40*c* are respectively sent, for each denomination or in a mixed state, to the cassettes 50*a*, 50*b* and 50*c* through the chutes 42*a*, 42*b* and 42*c*, and the coins are stored in the cassettes 50*a*, 50*b* and 50*c*.

After the feeding-out operation of coins in the coin holding space 73 of the coin holding-and-feeding-out unit 70 has been finished, the permanent magnet 24 in the supply unit 20 is controlled by the control unit 16 such that the permanent magnet 24 is moved to the back position as shown in FIG. 4B. Thus, an object having magnetism, which has been absorbed by the permanent magnet 24, falls down from the guide member 23 so as to be sent to the coin holding-and-feeding-out unit 70.

After that, the photosensor 79 detects whether there is a remaining object or not in the coin holding space 73 of the coin holding-and-feeding-out unit 70. In the embodiment 1 according to the present invention, regardless of the fact that the photosensor 79 detects or does not detect that there is a remaining object in the coin holding space 73 of the coin holding-and-feeding-out unit 70, as shown in FIG. 3B, the drive motor 74*b* opens the hopper member 74 so that the object remaining in the coin holding space 73 falls down by a weight thereof from the coin holding space 73.

Thus, even when there is a remaining object in the coin holding space 73 of the coin holding-and-feeding-out unit 70 but the photosensor 79 cannot detect the remaining object, the object remaining in the coin holding space 73 is inevitably caused to fall down from the coin holding space 73 after the feeding-out operation of coins by the coin holding-and-feeding-out unit 70. Thus, the remaining object in the coin holding space 73 of the coin holding-and-feeding-out unit 70 is prevented from remaining therein.

The coin handling method by the coin holding-and-feeding-out unit 70 in the embodiment 1 according to the present invention is not limited to the above-described method. In place thereof, only when the photosensor 79 detects that there is an object remaining in the coin holding space 73, the drive motor 74*b* may open the hopper member 74, as shown in FIG. 3B, so that the object remaining in the coin holding space 73 is caused to fall down from the coin holding space 73.

The object having fallen down from the coin holding space 73 collides with the shock sensor 66. When the object colliding with the shock sensor 66 is a deformed coin, a metal object other than coins, or another solid object, information that the object has collided with the shock sensor 66 is sent to the control unit 16, and the control unit 16 causes the display unit 18 to display the information. Thus, the operator is informed of the fact that a deformed coin, a metal object other than coins, or another solid object is sent to the reject unit 60, and the operator can take out the object from the reject unit 60. On the other hand, when the object having collided with the shock sensor 66 is a paper scrap or dust, the information that the object has collided with the shock sensor 66 is not sent to the control unit 16. Thus, the operator is not informed of the information.

According to the above manner, a series of coin handling operations in the coin handling system 10 is finished.

Figure 5:
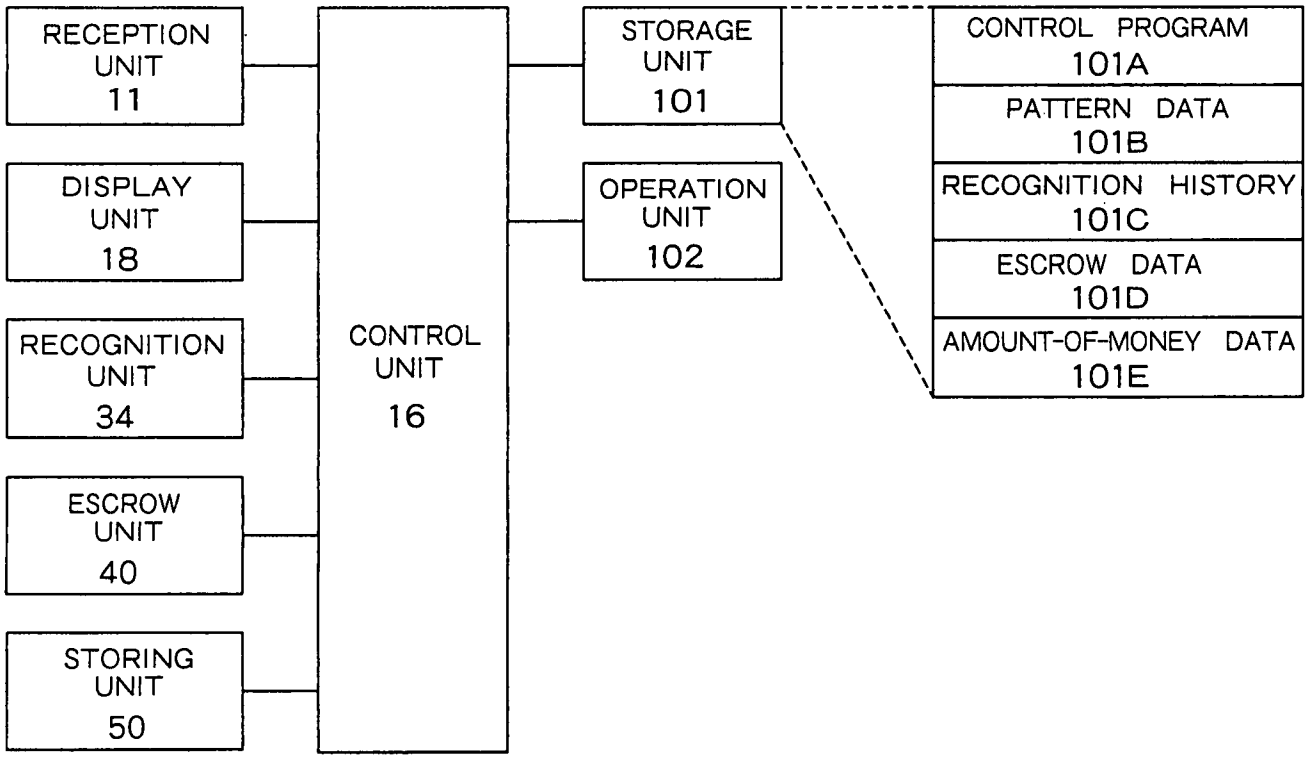
FIG. 5 is a block view showing functions of a coin handling system 10 in an embodiment 1 according to the present invention.

FIG. 5 is a block view showing functions of the coin handling system 10 in the embodiment 1 according to the present invention.

As shown in FIG. 5, in addition to the above structure, the coin handling system 10 in the embodiment 1 according to the present invention further includes a storage unit 101 and an operation unit 102.

The storage unit 101 is configured to store a control program 101A, pattern data 101B, a recognition history 101C, escrow data 101D and amount-of-money data 101E.

The control program 101A is a program for the control unit 16. The pattern data 101B are data including a plurality of storing patterns for the respective cassettes 50*a*, 50*b* and 50*c* of the storing unit 50. The recognition history 101C is data including a history of recognition results of the recognition unit 34. The escrow data 101D are data including amount-of-money data in the respective escrow parts 40*a*, 40*b* and 40*c* of the escrow unit 40. The amount-of-money data 101E are data including amount-of-money data in the respective cassettes 50*a*, 50*b* and 50*c* of the storing unit 50.

The operation unit 102 is provided with various keys for receiving instructions (a selection instruction, an edit instruction, etc.) from the operator.

In addition to the above structure including the reception unit 11, the display unit 18, the recognition unit 34, the escrow unit 40, and the storing unit 50, the control unit 16 is connected to the storage unit 101 and the operation unit 102. By activating the control program 101A stored in the storage unit 101, the control unit 16 is configured to control the storage unit 101 and the operation unit 102, in addition to the above structure including the inlet 14, the display unit 18, the recognition unit 34, the escrow unit 40, and the storing unit 50.

Next, process contents of the coin handling system 10 in the embodiment 1 according to the present invention will be described with reference to FIGS. 6 to 9.

Figure 6:
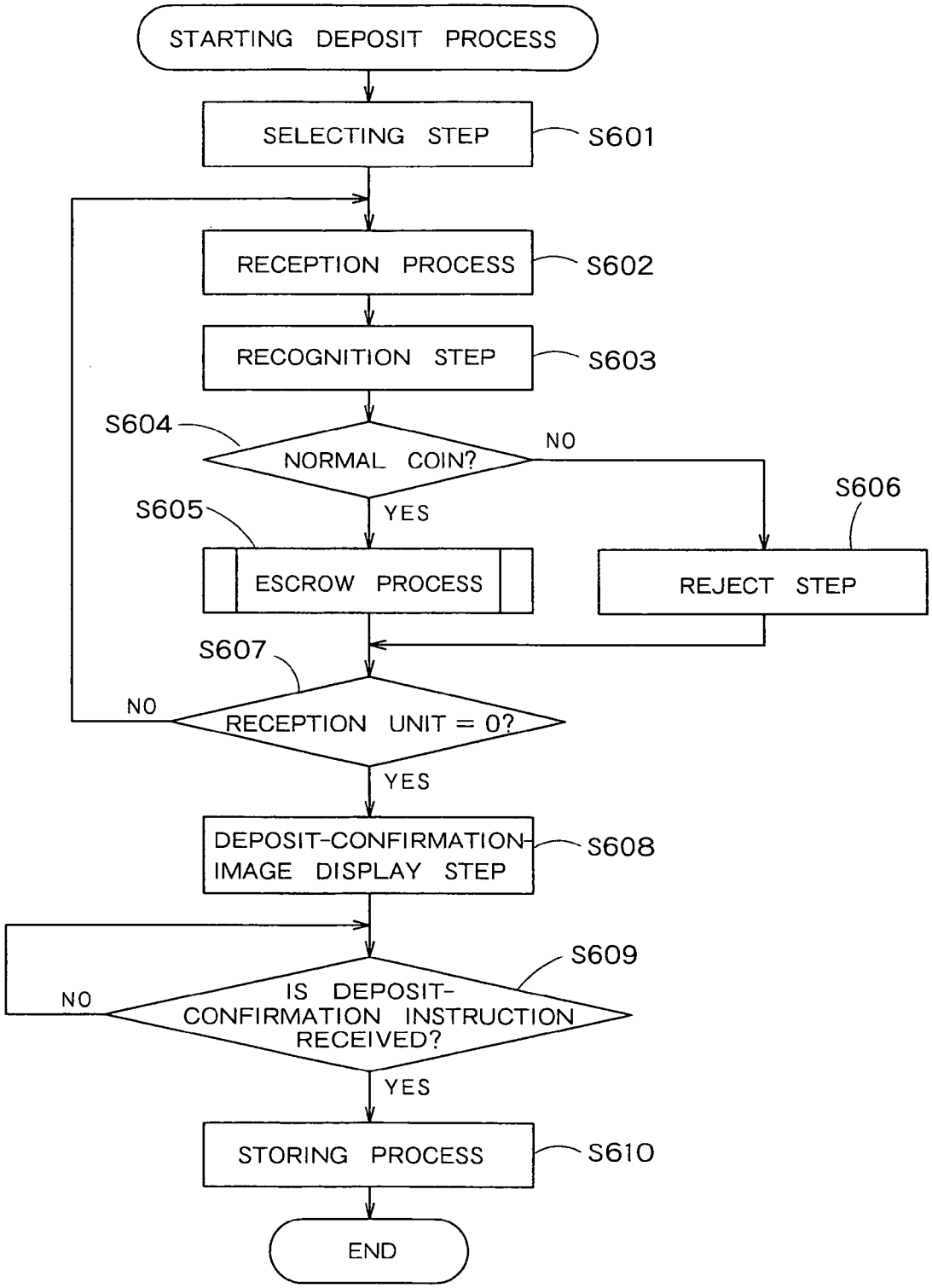
FIG. 6 is a flowchart showing a process procedure of a deposit process in the embodiment 1 according to the present invention.

FIG. 6 is a flowchart showing a process procedure of a deposit process in the embodiment 1 according to the present invention.

At first, as shown in FIG. 6, a selecting step (S601) is performed. In the selecting step (S601), the operation unit 102 receives a selection instruction of a storing pattern from an operator. In this embodiment, the control unit 16 serving also as the selecting unit reads out pattern data 1016 corresponding to the selection instruction from the storage unit 101.

Next, a reception step (S602) is performed. In the reception step (S602), the reception unit 11 receives coins put into the inlet 14 to the inside of the coin handling system 10.

Next, a recognition step (S603) is performed. In the recognition step (S603), the recognition unit 34 recognizes the coins received by the reception unit 11 in the reception step (S602), and sends the recognition result to the control unit 16. At this time, based on the recognition result, the control unit 16 judges each of the coins as a "normal coin" or a "rejected coin". In addition, the control unit 16 writes in the storage unit 101 the number of coins judged as "normal coins" for each denomination or the reject factor(s) of the coins judged as "rejected coins", as the recognition history 101C.

When judged as a "normal coin" by the control unit 16 (S604-YES), an escrow process (S605) is performed based on the pattern data 1016 which have been selected in the selecting step (S601). The escrow process (S605) is described hereafter.

On the other hand, when judged as a "rejected coin" by the control unit 16 (S604-NO), a reject step (S606) is performed. In the reject step (S606), the control unit 16 causes the coin judged as the "rejected coin" to be stacked in the reject unit 60.

The steps S601 to S606 are repeatedly performed until the coins that have been put into the inlet 14 finish going away therefrom (S607-NO).

When the coins that have been put into the inlet 14 finish going away therefrom (S607-YES), a deposit-confirmation-image display step (S608) is performed. In the deposit-confirmation-image display step (S608), the control unit 16 causes the display unit 18 to display a deposit-confirmation image including a message representing the numbers of coins that have been escrowed in the respective escrow parts 40*a*, 40*b* and 40*c* in the escrow process (S605) and a message promoting a deposit-acceptance instruction for fixing the process contents of the deposit process.

When the deposit-acceptance instruction is received by the operation unit 102 (S609-YES), a storing step (S610) is performed. In the storing step (S610), the control unit 16 causes the coins that have been escrowed in the respective escrow parts 40*a*, 40*b* and 40*c* to be stored in the respective corresponding cassettes 50*a*, 50*b* and 50*c*. At this time, the control unit 16 updates the amount-of-money data 101E of the respective cassettes 50*a*, 50*b* and 50*c*.

The deposit process in the embodiment 1 according to the present invention is finished after the storing step (S610).

Figure 7:
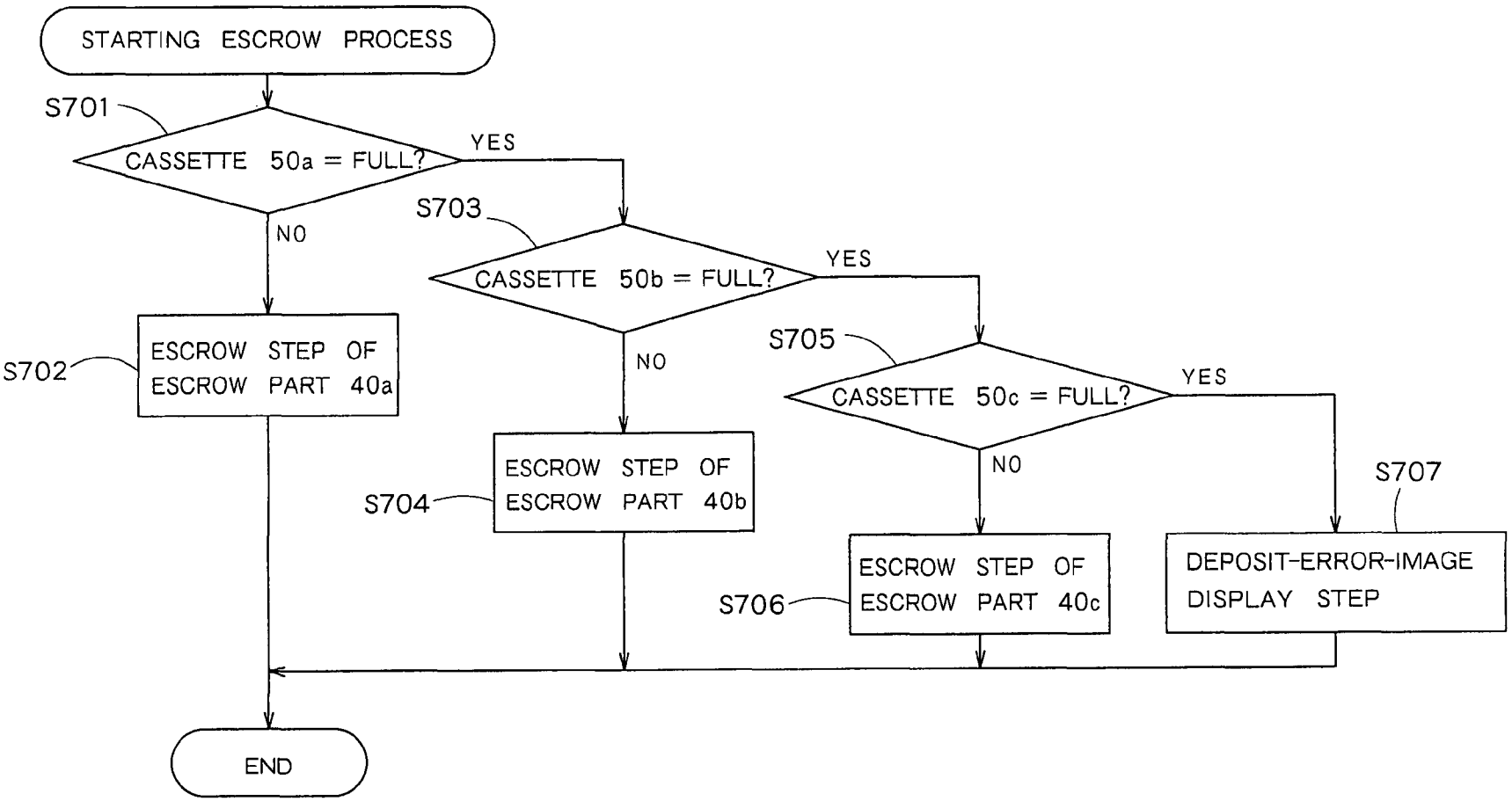
FIG. 7 is a flowchart showing a process procedure of one manner of escrow process in the embodiment 1 according to the present invention.

FIG. 7 is a flowchart showing a process procedure of one manner of escrow process in the embodiment 1 according to the present invention. This escrow process is performed when a storing pattern for improving collection efficiency of coins in the subsequent process after the deposit process (FIG. 6) is selected in the selecting step (S601 in FIG. 6).

At first, a storing state of the cassette 50*a*, which is located on a front position in the drawable direction of the storing unit 50 (i.e., which is located on a position that is firstly exposed outside the system when the storing unit 50 is drawn out), is judged (S701). When the storing state of the cassette 50*a* is not full (i.e., the number of coins stored in the cassette 50*a* is not maximum) (S701-NO), an escrow step of the escrow part 40*a* (S702) is performed. In the escrow step of the escrow part 40*a* (S702), the control unit 16 causes the coins which have been received in the reception step (S602 in FIG. 6) to be escrowed in the escrow part 40*a* corresponding to the cassette 50*a*. At this time, the control unit 16 updates the escrow data 101D of the escrow part 40*a*.

On the other hand, when the cassette 50*a* is full (i.e., the number of coins stored in the cassette 50*a* reaches a maximum) (S701-YES), a storing state of the cassette 50*b*, which is located on a position next to the cassette 50*a* in the drawable direction of the storing unit 50 (i.e., which is located on a position that is exposed outside the system next to the cassette 50*a* when the storing unit 50 is drawn out), is judged (S703). When the storing state of the cassette 50*b* is not full (S703-NO), an escrow step of the escrow part 40*b* (S704) is performed. In the escrow step of the escrow part 40*b* (S704), the control unit 16 causes the coins which have been received in the reception step (S602 in FIG. 6) to be escrowed in the escrow part 40*b* corresponding to the cassette 50*b*. At this time, the control unit 16 updates the escrow data 101D of the escrow part 40*b*.

When the cassettes 50*a* and 50*b* are full (S703-YES), a storing state of the cassette 50*c*, which is located on a position next to the cassette 50*b* in the drawable direction of the storing unit 50 (i.e., which is located on a position that is exposed outside the system next to the cassette 50*b* when the storing unit 50 is drawn out), is judged (S705). When the storing state of the cassette 50*c* is not full (S705-NO), an escrow step of the escrow part 40*c* (S706) is performed. In the escrow step of the escrow part 40*c* (S706), the control unit 16 causes the coins which have been received in the reception step (S602 in FIG. 6) to be escrowed in the escrow part 40*c*. At this time, the control unit 16 updates the escrow data 101D of the escrow part 40*c*.

When all the storing states of the respective cassettes 50*a*, 50*b* and 50*c* are full (S705-YES), a deposit-error-image display step (S707) is performed. In the deposit-error-image display step (S707), the control unit 16 causes the display unit 18 to display a deposit error image including a message showing a deposit error.

In the escrow process, each of the escrow parts 40*a*, 40*b* and 40*c* escrows the coins in each denomination mixed state. Thus, in the storing process (S610 in FIG. 6) subsequent to the escrow process, each of the cassettes 50*a*, 50*b* and 50*c* stores the coins in the denomination mixed state.

Figure 8:
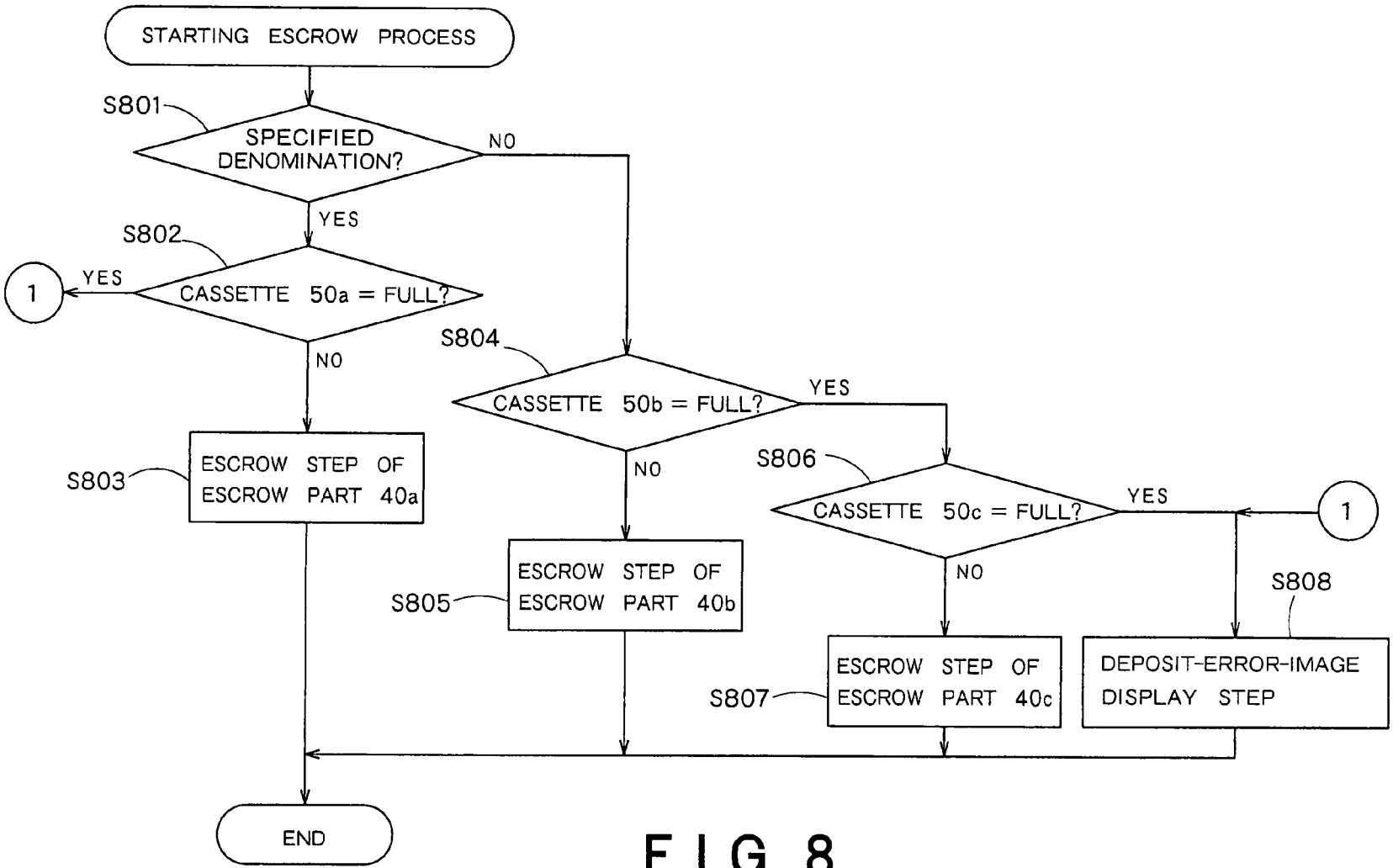
FIG. 8 is a flowchart showing a process procedure of another manner of escrow process in the embodiment 1 according to the present invention.

FIG. 8 is a flowchart showing a process procedure of another manner of escrow process in the embodiment 1 according to the present invention. This escrow process is performed when a storing pattern for sorting a specified denomination is selected in the selecting step (S601 in FIG. 6).

At first, based on the recognition result of the recognition step (S603 in FIG. 6), whether a denomination of the coin is a specified denomination or not is judged (S801). For example, when the denomination of the coin which has been recognized in the recognition step (S603 in FIG. 6) is a previously designated denomination, the denomination of the coin is judged as a "specified denomination". On the other hand, when the denomination of the coin is not the previously designated denomination, the denomination is judged as a "non-specified denomination".

When the denomination of the coin is a specified denomination (S801-YES), a storing state of the cassette 50*a*, which is located on a front position in the drawable direction of the storing unit 50 and is to be used for storing coins of the specified denomination, is judged (S802). When the storing state of the cassette 50*a* is not full (S802-NO), an escrow step of the escrow part 40*a* (S803) is performed. The escrow step of the escrow part 40*a* (S803) is performed in the same manner as S702 in FIG. 7.

When the storing state of the cassette 50*a* is full (S802-YES), the process advances to a deposit-error-image display step (S808) which is described below.

When the denomination of the coin is a non-specified denomination (S801-NO), a storing state of the cassette 50*b*, which is positioned next to the cassette 50*a* in the drawable direction of the storing unit 50 and is to be used for storing coins of the non-specified denomination, is judged (S804). When the storing state of the cassette 50*b* is not full (S804-NO), an escrow step of the escrow part 40*b* (S805) is performed.

The escrow step of the escrow part 40*b* (S805) is performed in the same manner as S704 in FIG. 7.

On the other hand, when the cassette 50*b* is full (S804-YES), a storing state of the cassette 50*c*, which is positioned next to the cassette 50*b* in the drawable direction of the storing unit 50 and is to be used for storing coins of the non-specified denomination, is judged (S806). When the storing state of the cassette 50*c* is not full (S806-NO), an escrow step of the escrow part 40*c* (S807) is performed. The escrow step of the escrow part 40*c* (S807) is performed in the same manner as S706 in FIG. 7.

When the storing states of the respective cassettes 50*b* and 50*c* are full (S806-YES), a deposit-error-image display step (S808) is performed. The deposit-error-image display step (S808) is performed in the same manner as 5707 in FIG. 7.

In this escrow process, the escrow part 40*a* escrows coins of only a specified denomination, while the escrow parts 40*b* and 40*c* escrow coins in a denomination mixed state. Thus, in the storing process (S610 in FIG. 6) subsequent to the escrow process, the cassette 50*a* stores the coins of a specified denomination, while the cassettes 50*b* and 50*c* store the coins in a denomination mixed state.

In this escrow process, the escrow parts 40*b* and 40*c* may escrow coins of a specified denomination, while the escrow part 40*a* may escrow coins of a non-specified denomination.

Figure 9:
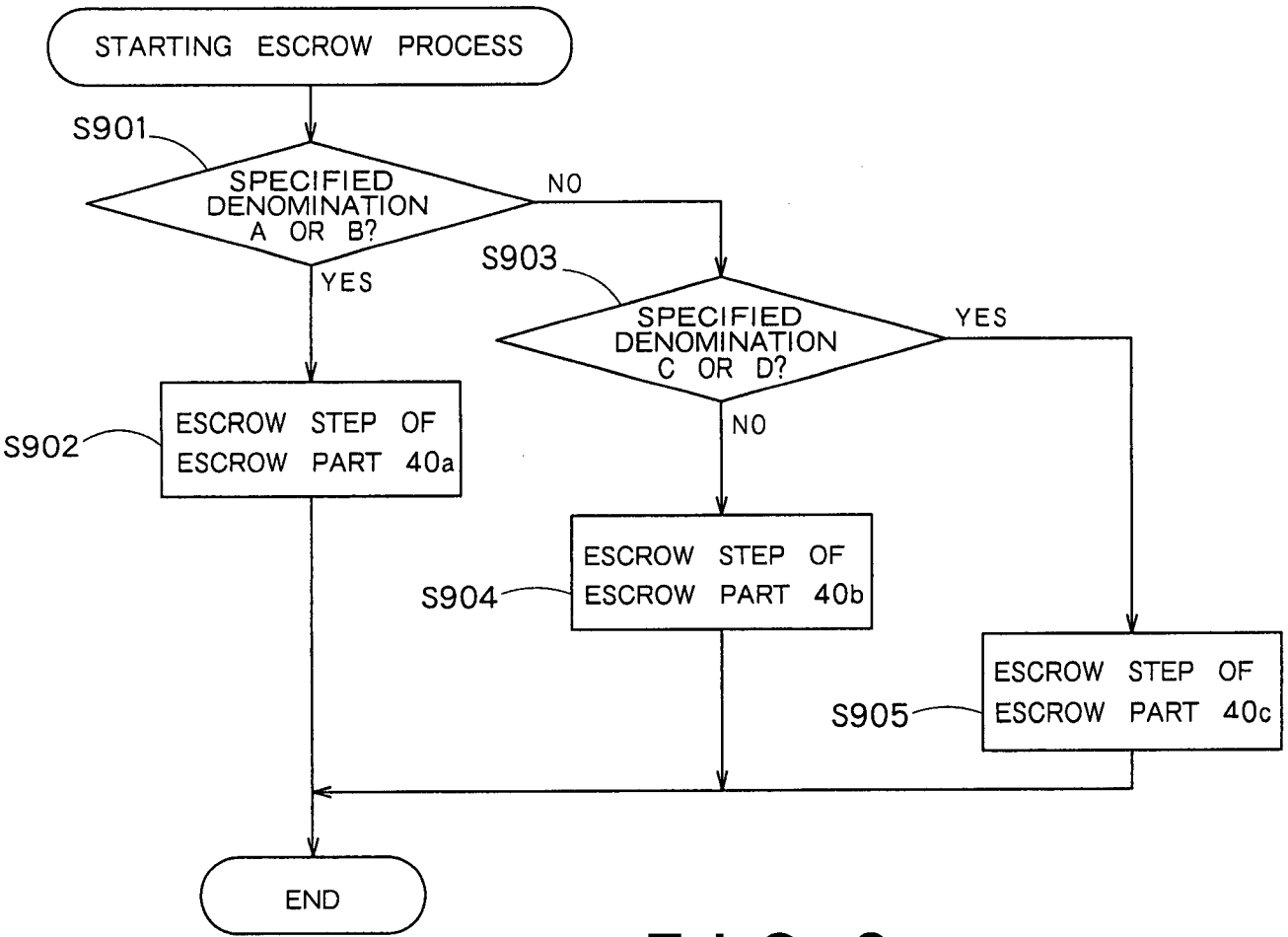
FIG. 9 is a flowchart showing a process procedure of a further manner of escrow process in the embodiment 1 according to the present invention.

FIG. 9 is a flowchart showing a process procedure of a further manner of escrow process in the embodiment 1 according to the present invention. This escrow process is performed when a storing pattern for improving efficiency of the deposit process (FIG. 6) is selected in the selecting step (S601 in FIG. 6).

At first, when a denomination which has been recognized in the recognition step (S603 in FIG. 6) is a denomination A whose circulation amount is the largest or a denomination B whose circulation amount is the smallest (S901-YES), an escrow step of the escrow part 40*a* (S902) is performed. The escrow step (S902) is performed in the same manner as S702 in FIG. 7.

In addition, when the denomination which has been recognized in the recognition step (S603 in FIG. 6) is a denomination C whose circulation amount is the second largest after the denomination A or a denomination D whose circulation amount is the second smallest after the denomination B (S903-YES), an escrow step of the escrow part 40*b* (S904) is performed. The escrow step (S904) is performed in the same manner as S704 in FIG. 7.

In addition, when the denomination which has been recognized in the recognition step (S603 in FIG. 6) is a denomination E whose circulation amount is the third largest after the denomination C or a denomination F whose circulation amount is the third smallest after the denomination D (S905-YES), an escrow step of the escrow part 40*c* (S906) is performed. The escrow step (S906) is performed in the same manner as S706 in FIG. 7.

In this escrow process, a specified denomination may be designated based on an amount handled by the user, instead of being based on the overall circulation amount.

In addition, in this escrow process, when the storing states of the respective cassettes 50*a*, 50*b* and 50*c* are full, a deposit-error-image display step may be performed in the same manner as S707 in FIG. 7.

In this escrow process, the respective escrow parts 40*a*, 40*b* and 40*c* escrow coins of two kinds of denomination in a two-denomination mixed state. Thus, in the storing process (S610 in FIG. 6) subsequent to the escrow process, the respective cassettes 50*a*, 50*b* and 50*c* store the coins of two kinds of denomination in a two-denomination mixed state.

In the embodiment 1 according to the present invention, each of the storing states of the cassettes 50*a*, 50*b* and 50*c* is judged based on comparison between an available capacity (which is difference between the full capacity and the amount of coins) of each of the cassettes 50*a*, 50*b* and 50*c* and an amount of coins in each of the escrow parts 40*a*, 40*b* and 40*c*. For example, when an available capacity of the cassette 50*a* is larger than an amount of coins in the escrow part 40*a*, the storing state of the cassette 50*a* is judged as "not full".

In addition, in the embodiment 1 according to the present invention, in the selecting step (S601 in FIG. 6), the control unit 16 serving also as a storing-pattern editing unit may create a new optimum storing pattern based on the recognition history 101C stored in the storage unit 101, for example, and the escrow process (S605 in FIG. 6) may be performed based on the storing pattern. In this case, the storing pattern is preferably stored in the storage unit 101. Alternatively, based on the recognition history 101C stored in the storage unit 101, for example, the control unit 16 serving also as the selection unit may read out corresponding pattern data 101B from the storage unit 101.

In addition, in the embodiment 1 according to the present invention, the operation unit 102 may receive an edit instruction for editing (creating) a storing pattern from the operator.

According to the embodiment 1, based on the pattern data 101B stored in the storage unit 101, the escrow processes (FIGS. 7 to 9) are performed. Thus, it is possible to improve the efficiency of the subsequent process after the deposit process while achieving compactness of the system, for every status of utilization by users.

In addition, according to the embodiment 1, the storage unit 101 stores the pattern data 101B including the storing pattern corresponding to the escrow process as shown in FIG. 7. Thus, when a specific collection staff such as a guard of an armoured car company draws out the storing unit 50, coins are sequentially collected from the cassette 50*a* which is located on a front position with respect to the collection staff. As a result, it is possible to improve an efficiency of the operation for collecting the coins stored in the storing unit 50.

In addition, according to the embodiment 1, the storage unit 101 stores the pattern data 101B including the storing pattern corresponding to the escrow process shown in FIG. 8. Thus, coins of only a specified denomination are stored in the cassette 50*a*. As a result, when a wrapping process of coins of a predetermined denomination is performed after the deposit process, an operation for sorting the coins of the specified denomination can be omitted.

In addition, according to the embodiment 1, the storage unit 101 stores the pattern data 101B including the storing pattern corresponding to the escrow process shown in FIG. 9. Thus, coins of all the denominations are stored in the cassettes 50*a*, 50*b* and 50*c* in a two-denomination mixed state. As a result, the coins of all the denominations are stored dispersedly in the respective cassettes 50*a*, 50*b* and 50*c*, and thus the efficiency of the deposit process (FIG. 6) can be improved.

In addition, according to the embodiment 1, the control unit 16 selects or creates a storing pattern based on the recognition history 101C of the recognition unit 34 and so on. Thus, an optimum storing pattern can be invariably selected or created depending on the status of utilization by the user.

In addition, according to the embodiment 1, the operation unit 102 receives an edit instruction for editing a storing pattern from the user. Thus, a desired storing pattern can be selected or created depending on the status of utilization by the user.

Next, an embodiment 2 according to the present invention is explained. The embodiment 2 relates to an example in which, when an escrow state of an escrow part that escrows coins becomes full, the escrowed coins are stored in a storing unit. Description of the same contents as those of the embodiment 1 is omitted.

Figure 10:
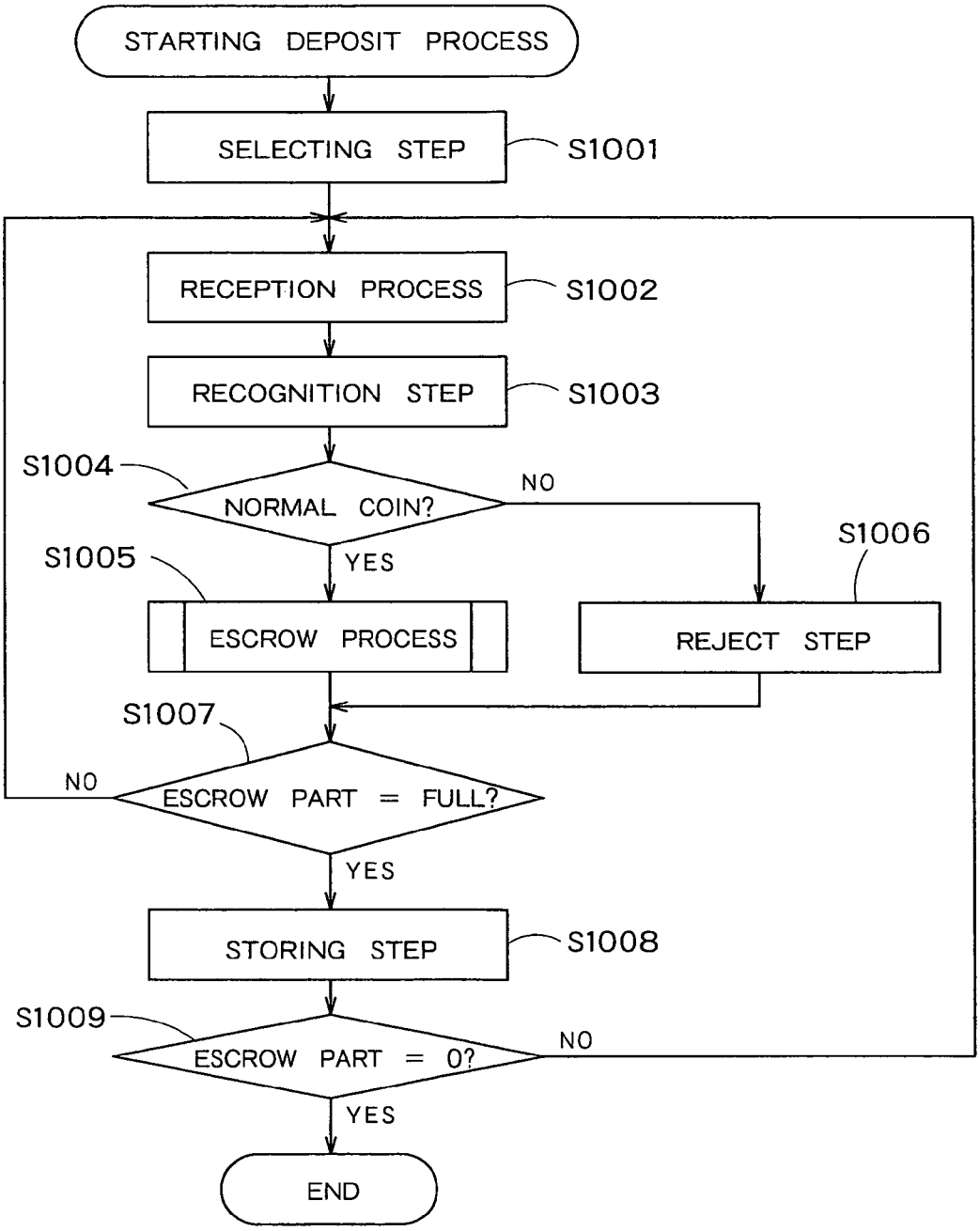
FIG. 10 is a flowchart showing a process procedure of a deposit process in an embodiment 2 according to the present invention.

FIG. 10 is a flowchart showing a process procedure of a deposit process in the embodiment 2 according to the present invention.

At first, as shown in FIG. 10, a selecting step (S1001) is performed. The selecting step (S1001) is performed in the same manner as the selecting step (S601 in FIG. 6) in the embodiment 1 according to the present invention.

Next, a reception step (S1002) is performed. The reception step (S1002) is performed in the same manner as the reception step (S602 in FIG. 6) in the embodiment 1 according to the present invention.

Next, a recognition step (S1003) is performed. The recognition step (S1003) is performed in the same manner as the recognition step (S603 in FIG. 6) in the embodiment 1 according to the present invention.

When a coin is judged as a "normal coin" by the control unit 16 (S1004-YES), an escrow process (S1005) is performed based on pattern data 1016 that have been selected in the selecting step (S1001). The escrow process (S1005) is performed in the same manner as the escrow processes (FIGS. 7 to 9) in the embodiment 1 according to the present invention.

On the other hand, when a coin is judged as a "rejected coin" by the control unit 16 (S1004-NO), a reject step (S1006) is performed. The reject step (S1006) is performed in the same manner as the reject step (S606 in FIG. 6) in the embodiment 1 according to the present invention.

The steps S1002 to S1006 are repeatedly performed until any one of the escrow states of the respective escrow parts 40*a*, 40*b* and 40*c* becomes full (S1007-NO).

When any one of the escrow states of the respective escrow parts 40*a*, 40*b* and 40*c* becomes full (S1007-YES), a storing step (S1008) of the cassette 50*a*, 50*b* or 50*c* corresponding to the escrow part 40*a*, 40*b* or 40*c* is performed. The storing step (S1008) is performed in the same manner as the storing step (S610 in FIG. 6) in the embodiment 1 according to the present invention.

The steps S1002 to S1008 are repeatedly performed until the number of coins escrowed in the escrow parts 40*a*, 40*b* and 40*c* becomes zero (S1009-NO).

The deposit process in the embodiment 2 according to the present invention is finished after the number of coins escrowed in the respective escrow parts 40*a*, 40*b* and 40*c* becomes zero (S1009-YES) after the storing step (S1008).

According to the embodiment 2, the escrow process (S1005) is repeatedly performed until any one of the escrow states of the respective escrow parts 40*a*, 40*b* and 40*c* becomes full, and the storing step (S1008) is performed after any one of the escrow states of the respective escrow parts 40*a*, 40*b* and 40*c* has become full. Thus, the efficiency of the deposit process can be more improved than that in the embodiment 1 according to the present invention.

The invention claimed is:

1. A coin handling system comprising a reception unit configured to receive a coin that has been put therein, a recognition unit configured to recognize the coin that has been received by the reception unit, a storing unit having a plurality of cassettes configured to store the coin that has been recognized by the recognition unit, a coin guiding unit configured to guide to any of the cassettes the coin that has been recognized by the recognition unit, a storage unit for storing a plurality of storing patterns of the coin assigned into the plurality of cassettes, a selecting unit for selecting a specific storing pattern among the plurality of storing patterns, and a control unit configured to control the coin guiding unit in such a manner that the coin that has been recognized by the recognition unit is stored in a corresponding cassette, in accordance with the selected storing pattern, when a specific storing pattern is selected among the plurality of storing patterns.

2. The coin handling system according to claim 1, wherein the storing unit is drawable in a direction in which the plurality of cassettes are arranged, and the storage unit stores, as one of the plurality of storing patterns, a storing pattern in accordance with which coins are stored in a denomination mixed state in the cassettes in order beginning from the front side in the drawable direction of the storing unit.

3. The coin handling system according to claim 1, wherein an escrow unit configured to escrow the coin is provided for each of the plurality of cassettes, and the storage unit stores, as one of the plurality of storing patterns, a storing pattern in accordance with which coins that have reached a maximum number in an escrow unit are stored in a cassette corresponding to the escrow unit among the escrow units corresponding to the respective cassettes.

4. The coin handling system according to claim 1, wherein the storage unit stores, as one of the plurality of storing patterns, a storing pattern in accordance with which coins of a predetermined specified denomination are stored in one of the cassettes and in accordance with which coins of a non-specified denomination are stored in the other cassettes in a denomination mixed state.

5. The coin handling system according to claim 1, wherein the storage unit stores, as one of the plurality of storing patterns, a storing pattern in accordance with which coins of two kinds of denomination are stored in each of the cassettes in a two-denomination mixed state.

6. The coin handling system according to claim 1, wherein the selecting unit has an operation unit for receiving a selection instruction for selecting a specific storing pattern among the plurality of storing patterns.

7. The coin handling system according to claim 1, wherein the storage unit is configured to further store a recognition history by the recognition unit, and the selecting unit is configured to select a specific storing pattern among the plurality of storing patterns, based on the recognition history stored in the storage unit.

8. The coin handling system according to claim 1, further comprising a storing-pattern editing unit configured to create a new storing pattern and cause the storage unit to store the new storing pattern as one of the plurality of storing patterns.

9. The coin handling system according to claim 8, wherein the storage unit is configured to further store a recognition history by the recognition unit, and the storing-pattern editing unit is configured to create a new storing pattern based on the recognition history stored in the storage unit.

10. The coin handling system according to claim 8, wherein the storing-pattern editing unit has an operation unit for receiving an edit instruction for editing the new storing pattern.

* * * * *